US006119698A

United States Patent [19]

Tanigawa et al.

[11] Patent Number: 6,119,698

[45] Date of Patent: Sep. 19, 2000

[54] FILTER MOUNTING APPARATUS

[75] Inventors: Masaaki Tanigawa; Tatsuya Hasegawa; Koichiro Obara, all of Tokyo, Japan

[73] Assignee: Japan Tobacco, Inc., Tokyo, Japan

[21] Appl. No.: 09/230,802

[22] PCT Filed: Jun. 19, 1997

[86] PCT No.: PCT/JP97/02110

§ 371 Date: Feb. 9, 1999

§ 102(e) Date: Feb. 9, 1999

[87] PCT Pub. No.: WO98/57557

PCT Pub. Date: Dec. 23, 1998

[51] Int. Cl.[7] ..... A24C 5/47

[52] U.S. Cl. ..... 131/94; 131/88; 131/93

[58] Field of Search ..... 131/94, 88, 93

[56] References Cited

U.S. PATENT DOCUMENTS 4,667,687 5/1987 Hinchcliffe ..... 131/94
4,825,882 5/1989 Hinz .
5,135,008 8/1992 Oesterling et al. .

FOREIGN PATENT DOCUMENTS 63-196257 8/1988 Japan .
4211355 8/1992 Japan .
8-51969 2/1996 Japan .

*Primary Examiner*—James Derrington
*Assistant Examiner*—Mark Halpern
*Attorney, Agent, or Firm*—Birch, Stewart, Kolasch & Birch, LLP

[57] ABSTRACT

A filter attaching device comprises a receiving drum for forming a tip-paper piece, and a rolling plate which cooperates with the peripheral surface of the receiving drum to define a rolling passage. The rolling plate has a pair of receding portions 54 arranged on the left and right sides of the upper surface thereof. Due to the receding portions 54, contact resistance produced between the rolling surface and an intermediate product rolling on in the rolling passage, or more specifically, cigarettes included in the intermediate product is reduced.

7 Claims, 5 Drawing Sheets

FILTER MOUNTING APPARATUS

This application is the national phase under 35 U.S.C. §371 of prior PCT International Application No. PCT/JP97/02110 which has an International filing date of Jun. 19, 1997 which designated the United States of America.

TECHNICAL FIELD

The present invention relates to a filter attaching device for connecting two cigarettes with a filter plug to form a double-filter-cigarette corresponding to two filter-cigarettes.

BACKGROUND ART

As is well known, a double-filter-cigarette is obtained by first forming an intermediate product having a filter plug interposed between two cigarettes, and then wrapping a tip-paper piece around the intermediate product to thereby connect the two cigarettes with the filter plug. The double-filter-cigarette is then cut at its center, that is, at its filter plug portion, and formed into individual filter-cigarettes.

The double-filter-cigarette as mentioned above is formed by a filter attaching device, and such filter attaching device is disclosed, for example, in Japanese Patent Preliminary Publication No. Sho 63-196257 or Japanese Patent Preliminary Publication No. Hei 4-211355. The filter attaching device comprises a supply drum for supplying a tip-paper piece and a rolling plate. The supply drum and the rolling plate cooperate with each other, and define a rolling passage for the above mentioned intermediate product. More specifically, the rolling passage is defined by the peripheral surface of the supply drum and the upper surface, that is, the rolling surface of the rolling plate. When the intermediate product is introduced into the rolling passage, a tip-paper piece is supplied onto the peripheral surface of the intermediate product, simultaneously. One of the surfaces of the tip-paper piece is a surface to which glue has been applied. Therefore, as the intermediate product rolls on in the rolling passage, the tip-paper piece is wrapped around and glued to the intermediate product at the same time. As a result, the double-filter-cigarette as mentioned above is obtained. After the tip-paper piece is wrapped, a lap portion where both ends of the tip-paper piece overlap each other is formed.

In recent years, speed of carrying the intermediate product tends to be increased in order to improve productivity of manufacturing the filter-cigarette. In order to ensure stable wrapping of the tip-paper piece around the intermediate product, or in other words, sufficient fastening of the intermediate product by the tip-paper piece even when the intermediate product is carried at a high speed, the intermediate product is made to roll for rotations several times while the product passes through the rolling passage.

While the intermediate product passes through the rolling passage, the intermediate product is sandwiched between the supply drum and the rolling plate. Therefore, the more times the intermediate product rotates, the more the cigarettes included in the intermediate product are kneaded and loosened. Thus, the hardness of the cigarette decreases.

The formed double-filter-cigarette is then brought out of the rolling passage and carried on the carrying path on the downstream side. In this process, if the cigarettes do not have a sufficient hardness, it causes shredded tobacco's falling off both ends of the double-filter-cigarette or one ends of the filter-cigarettes. Thus, it may cause so-called accidental falling of shredded tobacco constituting a cigarette end portion.

DISCLOSURE OF THE INVENTION

An object of the present invention is to provide a filter attaching device which does not cause a decrease in hardness of the cigarette and prevents accidental falling of shredded tobacco constituting a cigarette end portion.

The above object is achieved by a filter attaching device according to the present invention. The filter attaching device of the present invention comprises reducing means for reducing contact resistance produced between the cigarettes included in the above described intermediate product and the rolling passage when the intermediate product is made to roll on in the rolling passage. The reducing means comprises a pair of receding portions formed on one of a peripheral surface of the supply drum and a rolling surface. The receding portions are apart from each other with a distance corresponding to the width of the tip-paper piece as viewed in the direction in which the intermediate product rolls on in the rolling passage, and extend along the rolling passage.

Due to the above mentioned pair of receding portions, the area of the peripheral surface of the supply drum or the rolling surface which comes in contact with the cigarettes included in the intermediate product when the intermediate product rolls on in the rolling passage is reduced. Therefore, kneading and loosening of the cigarettes in the product is restrained, and the double-filter-cigarette can be formed with the hardness of the cigarettes maintained. This prevents shredded tobacco's falling off each end of the double-filter-cigarette, when the double-filter-cigarette is next bought out of the rolling passage and further carried on a carrying path which is on the downstream side of the rolling passage. Thus, the efficiency of manufacturing the filter-cigarettes is improved.

It is desirable that the pair of receding portions are formed on the rolling surface of the rolling plate. Each receding portion extends along the rolling passage excluding the entrance portion of the rolling passage, and opens sideward at the corresponding side edge of the rolling surface. In this case, the intermediate product is , directly after introduced into the rolling passage, supported by the rolling surface in its full length. Therefore, the intermediate product is allowed to roll in a stable manner, so that the tip-paper piece is securely wrapped around the intermediate product, that is, the double-filter-cigarette is formed securely. Thus, it is desirable that the entrance portion of the rolling passage has a length required for allowing the intermediate product to roll for a first one rotation in the rolling passage.

When the cigarette portions of the formed double-filter-cigarette next pass the corresponding receding portions, the area of the rolling surface which comes in contact with the cigarette portions are much reduced, since each receding portion extends up to the corresponding side edge of the rolling plate.

The above mentioned pair of receding portions may extend from the entrance to the exit of the rolling passage. In this case, it is desirable that the pair of receding portions are formed in a manner that both side edge portions of the rolling surface are left. When the intermediate product or the formed double-filter-cigarette is made to roll on in the rolling passage, the intermediate product or the formed double-filter-cigarette is supported by the rolling surface at both end portions as well as at a central portion thereof. Thus, stable rolling is maintained. Desirably, the rolling surface further comprises second receding portions provided at both side edges of the rolling surface to extend along the above mentioned receding portions. The second receding portions prevent both ends of the intermediate product or the double-filter-cigarette from touching the rolling surface.

Further, the rolling surface may have a projecting ridge at the entrance of the rolling passage. The projecting ridge is an arc-like shape in cross section and extends in the direction traversing the rolling passage. Such projecting ridge narrows the entrance of the rolling passage and induces the rolling of the intermediate product to thereby produce secure initial adhesion of the tip-paper piece to the intermediate product.

BEST MODE OF CARRYING OUT THE INVENTION

Figure 1:
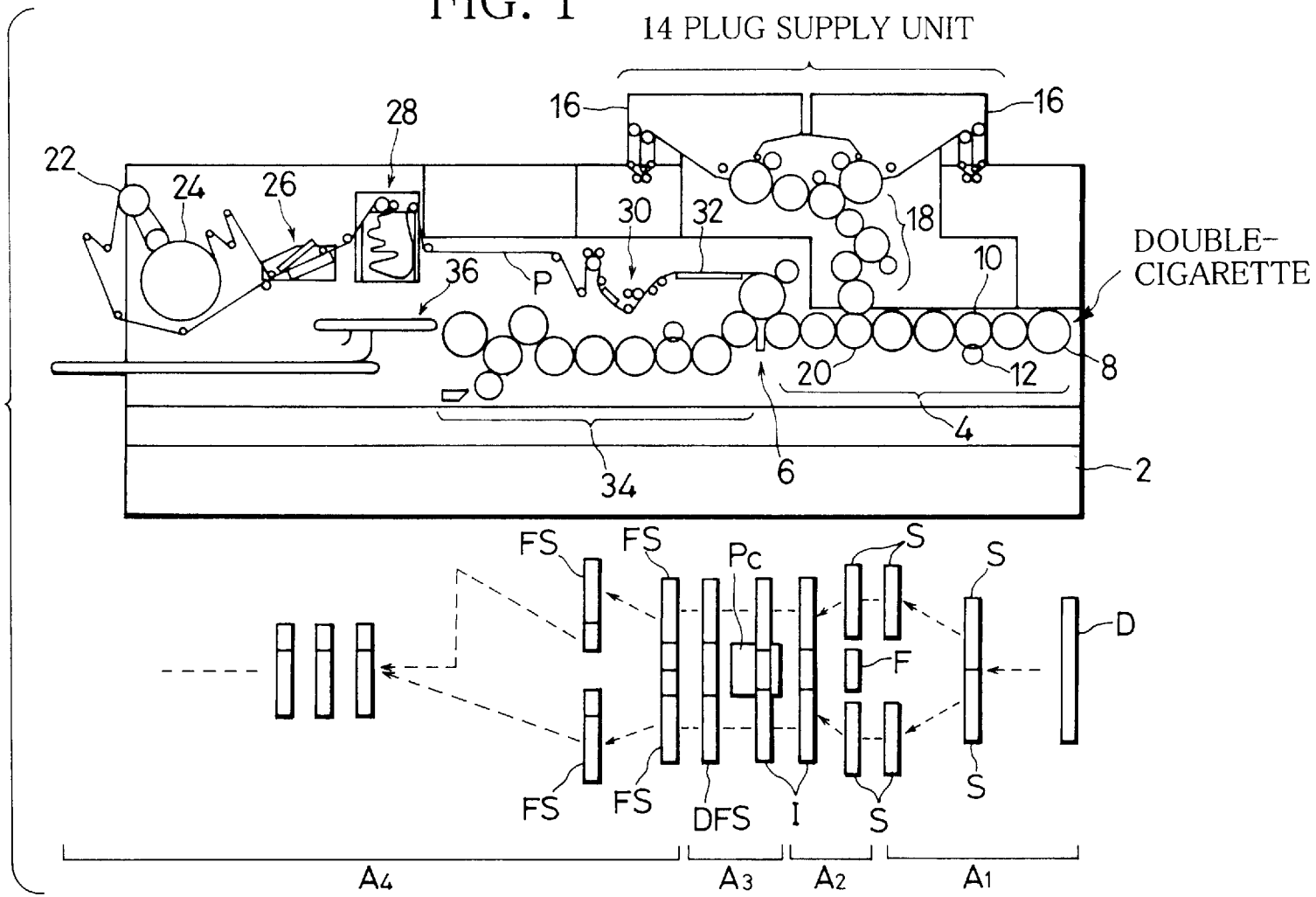
FIG. 1 is an illustration schematically showing a filter-cigarette manufacturing machine and the manufacturing process thereby.

As shown in FIG. 1, a filter cigarette manufacturing machine has a main frame 2. On the right side of the main frame 2 as viewed in FIG. 1, a drum train 4 is arranged. The drum train 4 provides a carrying path for a double-cigarette and single-cigarettes, and extends up to a rolling section (filter attaching device) 6.

The drum train 4 comprises a plurality of grooved drums. Each grooved drum has a plurality of carrier grooves on the peripheral surface thereof. The carrier grooves are arranged at equal spaces in the peripheral direction of the grooved drum. The grooved drum at the right end of the drum train 4 as viewed in FIG. 1 is an entrance drum, that is, a so-called catcher drum 8. The grooves of the catcher drum 8 are adapted to receive double-cigarettes D from the cigarette manufacturing machine (not shown), in order. It is to be noted that a double-cigarette D has a length twice as large as the length of a cigarette portion of a filter-cigarette.

As the drums of the drum train 4 rotate, the double-cigarette D received by the carrier groove of the catcher drum 8 is carried toward the rolling section 6 through the drums adjacent on the left of the catcher drum 8 as viewed in FIG. 1 in a manner that the double-cigarette D is passed from one drum to another. One grooved drum 10 of the drum train 4 has a rotary knife 12. The rotary knife 12 cuts the double-cigarette D held on the grooved drum 10 at its center to form two single-cigarettes S of the same length. Then, the two single-cigarettes S are carried from the grooved drum 10 through the adjacent grooved drums provided for each of the two single-cigarettes in a manner that they are each passed from one drum to another. In this carrying process, the two single-cigarettes are separated from each other in their axial direction, so that a predetermined space is produced between the two single-cigarettes S. In FIG. 1, area A, shows the manufacturing process in which a double-cigarette D is cut into two single-cigarettes S and then the two single-cigarettes S are separated from each other.

Above the drum train 4 is arranged a filter plug supply device 14. The supply device 14 has a pair of hoppers, that is, left and right hoppers 16. The hoppers 16 hold a plurality of filter rods (not shown). The left and right hoppers 16 are connected via a drum train 18 to the drum train 4. More specifically, same as the drum train 4, the drum train 18 comprises a plurality of grooved drums. The grooved drum at the lower end of the drum train 18 is connected to an assembly drum 20 in the drum train 4. The assembly drum 20 is a grooved drum adapted to receive the single-cigarettes S which have been separated from each other in the drum train 4.

The drum train 18 takes filter rods one by one from each of the left and right hoppers 16 and carries them toward the assembly drum 20. While carried in this way to the assembly drum 20, the filter rods are formed as individual filter plugs F through cutting, grading, alignment and so forth. The filter plugs F are supplied to the assembly drum 20 one by one, in order. Specifically, each filter plug F is supplied to the assembly drum 20 in a manner that the filter plug F is positioned in the space produced between the two single-cigarettes S. It is to be noted that the filter plug F has a length twice as large as the length of a filter portion of the filter-cigarette.

If one of the hoppers 16 holds charcoal filter rods and the other hopper 16 holds plain filter rods, a filter plug F formed as a dual filter plug is supplied. If both of the left and right hoppers 16 hold plain filter rods, the filter plug F supplied for assembling is a plain filter plug.

Then, the two single-cigarettes S and one filter plug F assembled on the assembly drum 20 are passed onto the next grooved drum, that is, an alignment drum, and aligned on the alignment drum, so that each single-cigarette S is tightly in contact with each end of the filter plug F. Thus, at this time, an intermediate product I for a double-filter-cigarette is obtained. Then, the intermediate product I is passed from the alignment drum to an exit drum which is at the left end of the drum train 4, and then supplied to the rolling section 6. In FIG. 1, area $A_2$ shows how a filer plug F is supplied to be positioned between two single-cigarettes S and how they are then formed into an intermediate product I.

To the rolling section 6 extends a supply line for tip-paper P. The supply line comprises a pair of paper rolls 22 and 24. The paper rolls 22 and 24 are arranged at the upper left end portion of the main frame 2 as viewed in FIG. 1. Of the paper rolls, one roll 22 is being used and the other roll 24 is a waiting roll. From the paper roll 22 now being used is drawn out tip-paper P. The tip-paper P is then guided to the rolling section 6 by a plurality of guide rollers included in the supply line.

In the supply line are arranged, from the upstream side to the downstream side, a paper connecting device 26 for use in exchange of rolls to be used, a reservoir 28 for the tip-paper P, an applying device 30 for applying glue to one of the surfaces of the tip-paper P, and a heater 32 for drying, to some extent, the surface of the tip-paper P to which glue has been applied, in this order.

At the rolling section 6, the tip-paper P is cut into tip-paper pieces Pc of a predetermined length. The tip-paper piece Pc is wrapped around the intermediate product I, so that a double-filter-cigarette DFS is obtained. It is to be noted that the tip-paper piece Pc is wrapped to cover the portion of the intermediate product I which comprises the filter plug in the center and further comprises the end portion of each single-cigarette S. Thus, the tip-paper piece Pc connects the filter plug F with the two single-cigarettes S. In FIG. 1, area $A_3$ shows how a tip-paper piece Pc is wrapped around an intermediate product I in the rolling section 6.

The double-filter-cigarette DFS is then supplied to a drum train 34 extending from the rolling section 6 and carried on the drum train 34. Same as the drum train 4, the drum train 34 comprises a plurality of grooved drums, and the double-filter-cigarette DFS is carried through the grooved drums of the drum train 34 in a manner that it is passed from one grooved drum to another. While carried, the double-filter-cigarette DFS is cut by a rotary knife at its center into two filter-cigarettes FS, and the two filter-cigarettes are separated from each other in their axial direction.

Then, each filter-cigarette FS is inspected in respect of the above mentioned accidental falling of a cigarette tip portion, dilution and the like, and a defective filter-cigarette FS is excluded from the drum train 34.

The end of the drum train 34 is connected to a conveyer 36. The conveyer 36 receives the filter-cigarette FS from the drum train 34. On the conveyer 36, the filter-cigarettes FS are oriented in the same direction, and then supplied to a packaging machine (not shown). In FIG. 1, area $A_4$ shows how a double-filter-cigarette DFS is, in the drum train 34, cut into two filter-cigarettes and how the two filter-cigarettes FS are then separated from each other.

Figure 2:
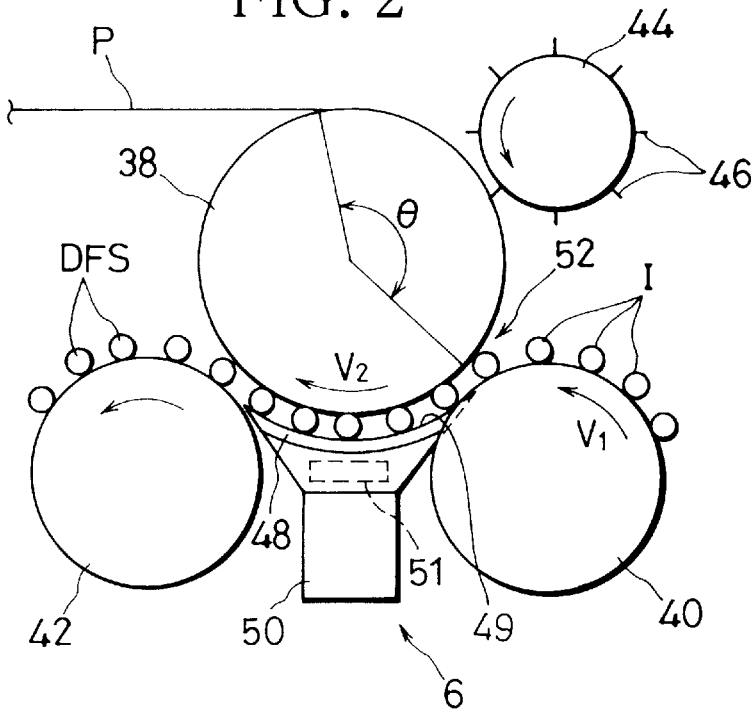
FIG. 2 is an illustration showing a rolling section of the manufacturing machine of FIG. 1 with an enlarged scale.

As shown in FIG. 2, the rolling section 6 comprises a receiving drum 38 for receiving the tip-paper P. The receiving drum 38 is arranged between the above mentioned exit drum 40 of the drum train 4 and an entrance drum 42 of the drum train 34. More specifically, the receiving drum 38 is arranged above the drums 40, 42 in a manner such that the receiving drum 38 connects the drums 40, 42.

The peripheral surface of the receiving drum 38 has a width slightly larger than the length of the above mentioned intermediate product I. The central part of the peripheral surface of the receiving drum 38 as viewed in the axial direction of the receiving drum 38 is formed as a suction surface in its whole circumference. Therefore, the tip-paper P guided along the supply line is sucked onto the suction surface of the receiving drum 38 with its surface to which glue has been applied being directed outward. Then, as the receiving drum 38 is rotated clockwise as viewed in FIG. 2, the tip-paper P travels in the direction of rotation of the receiving drum 38. Here, the suction surface of the receiving drum 38 is so arranged that suction is supplied to the suction surface only within a region of a rotation angle θ as viewed in the direction of rotation of the receiving drum 38. As shown in FIG. 2, the region of the rotation angle θ starts at around the top position of the receiving drum 38 and ends at the position where the periphery of the receiving drum 38 comes close to the periphery of the exit drum 40.

Supposing that the carrying speed of the intermediate product I in the drum train 4 is $V_1$, the moving speed of the peripheral surface of the receiving drum 38, that is, the peripheral speed $V_2$ of the receiving drum 38 is determined to be twice as high as the carrying speed $V_1$ of the intermediate product I.

Outside the receiving drum 38, in the region corresponding to the suction region θ where the tip-paper P is sucked, a bladed drum 44 is arranged rotatably. The bladed drum 44 has a plurality of blades 46 on its peripheral surface, and the blades 46 are arranged at equal spaces in the peripheral direction of the bladed drum 44. The bladed drum 44 is rotated in the direction reverse to the direction of rotation of the receiving drum 38. Therefore, when the receiving drum 38 rotates and the tip-paper P on the receiving drum 38 passes by the bladed drum 44, the tip-paper P is cut by the blades 46 of the bladed drum 44 into pieces of a predetermined length. Thus, tip-paper pieces Pc are formed on the suction surface of the receiving drum 38. The tip-paper pieces Pc are then carried to the above mentioned end of the suction region. It is to be noted that the suction surface of the receiving drum 38 defines the supplying path for the tip-paper piece Pc.

Under the receiving drum 38 is arranged a rolling plate 48. The rolling plate 48 is held by a holder 50. The upper surface of the rolling plate 48 is formed as a rolling surface 49 which is curved in an arc-like shape and extends along the peripheral surface of the receiving drum 38. The length of the rolling surface 49 in the peripheral direction of the receiving drum 38 is three times as large as the circumference of the double-filter-cigarette DFS, or in other words, the circumference of the intermediate product I. Therefore, the intermediate product I can rotate on the rolling surface 49 three times in the peripheral direction of the receiving drum 38. The rolling plate 48 has a width approximately the same as the length of the intermediate product I as viewed in the axial direction of the receiving drum 38. The holder 50 contains an electric heater 51. The electric heater 51 is positioned in the vicinity of the rolling plate 48. The electric heater 51 heats the rolling plate 48 to an appropriate temperature.

The rolling plate 48 and the receiving drum 38 define a rolling passage 52. The rolling passage 52 is curved in a downward convex shape. The height of the rolling passage, that is, the distance between the rolling surface 49 and the peripheral surface of the receiving drum 38 is slightly smaller than the diameter of the intermediate product I and constant in the peripheral direction of the receiving drum 38.

Figure 3:
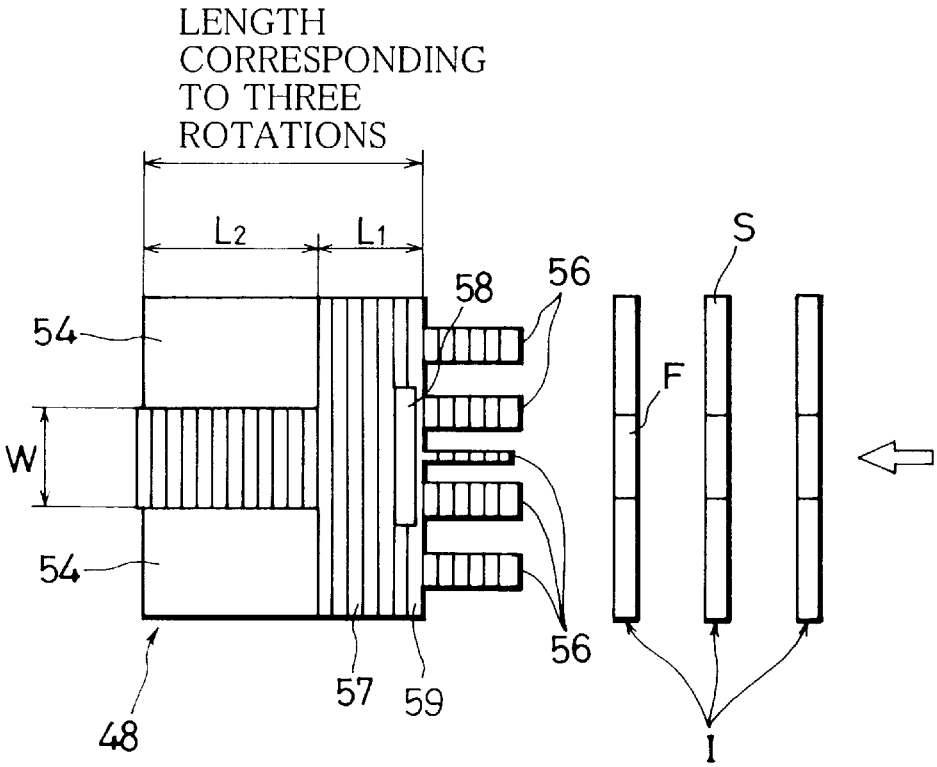
FIG. 3 is a plan view of a rolling plate of FIG. 2.

As shown in FIG. 3, a pair of receding portions 54 are formed on the rolling surface 49. The receding portions 54 are on the downstream side of the rolling passage 52 as viewed in the direction of rotation of the receiving drum 38, and spaced apart from each other to the left and right, symmetrically. The receding portions 54 have a depth of, for example, 0.5 to 1.0 mm. The portion of the rolling surface 49 which is left between the left and right receding portions 54 has a width W slightly larger than the length of the filter plug F included in the intermediate product I. More specifically, the width W is the same as the width of the tip-paper P.

The length of the rolling passage 52 from its entrance to the pair of receding portions 54 as measured along its arc-like shape, that is, the length $L_1$ of the rolling surface 49 from its upstream-side end to the receding portions 54 as measured along its arc-like shape is equal to the circumference of the intermediate product I, and the length $L_2$ of the left and right receding portions 54 as measured along their arc-like shape is twice as large as the circumference of the intermediate product I.

From the upstream-side end of the rolling plate 48 project a plurality of fingers 56. The fingers 56 extend along the imaginary extended surface of the rolling surface 49. Each finger 56 extends into the exit drum 40 without preventing the rotation of the exit drum 40. Specifically, the exit drum 40 has a plurality of peripheral grooves (not shown) formed on its peripheral surface to correspond to the fingers 56. The fingers 56 have a function of scooping the intermediate product I carried on the exit drum 40 and introducing the product I securely to the rolling passage 52. The downstream-side end of the rolling plate 48 is positioned in the vicinity of the peripheral surface of the entrance drum 42. Thus, the rolling surface 49 smoothly connects the peripheral surface of the exit drum 40 and the peripheral surface of the entrance drum 42.

Excepting the above mentioned left and right receding portions 54, the rolling surface 49 and the upper surface of each finger 56 are formed as a gripping surface 57 having a large friction coefficient. Specifically, the gripping surface 57 is obtained by knurling the rolling surface 49 and the upper surfaces of the fingers 56. Further, a slightly projecting ridge 58 is formed at the upstream-side end of the rolling surface 49, in the center thereof. The projecting ridge 58 is an arc shape in cross section and extends in the width direction of the rolling plate 48 with a length larger than the above mentioned width W.

The operation of the above mentioned rolling section 6 will be described below.

Figure 4:
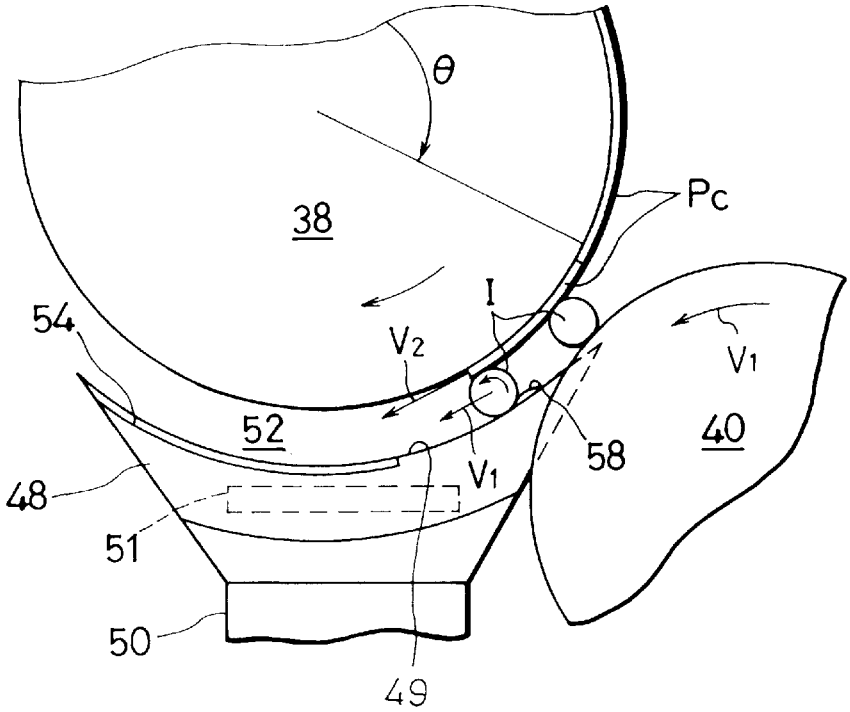
FIG. 4 is an illustration for explaining how the rolling section of FIG. 2 works.

As shown in FIG. 4, supposing that the intermediate product I is carried on the exit drum 40 of the drum train 4 with a carrying speed $V_1$, the intermediate product I comes into the rolling passage 52 from its entrance with the same carrying speed Vl. At the entrance of the rolling passage 52, the central portion of the intermediate product I, that is, the portion comprising the filter plug F and the end portion of each single-cigarette S comes on the projecting ridge 58 of the rolling surface 49, and the intermediate product I starts rolling. At the same time, the tip-paper piece Pc on the receiving drum 38 comes into the entrance of the rolling passage 52 with the supplying speed $V_1$, and the leading edge of the tip-paper piece Pc is made to adhere to the peripheral surface of the intermediate product I.

At that time, since the intermediate product I already starts rolling, the moving speed of the periphery of the intermediate product I is increased to be higher than the carrying speed $V_1$, and approximately agrees with the supplying speed $V_2$ of the tip-paper piece Pc. In addition, the projecting ridge 58 narrows the distance between the rolling surface 49 and the receiving drum 38. Therefore, the leading edge of the tip-paper piece Pc is made to adhere to the peripheral surface of the intermediate product I securely, so that the initial adhesion of the tip-paper piece Pc is effected in a stable manner.

At that time, since the next intermediate product I on the exit drum 40 has not reached the entrance of the rolling passage 52 yet, the same tip-paper piece Pc does not ever adhere to the present intermediate product I and the next intermediate product I at the same time.

When the intermediate product I has come over the projecting ridge 58, the leading edge of the tip-paper piece Pc is held between the receiving drum 38 and the intermediate product I, and at that time, the tip-paper piece PC is already out of suction by the receiving drum 38. Therefore, the intermediate product I rolls on in the rolling passage 52 with a speed which agrees with the peripheral speed $V_2$ of the receiving drum 38. Such rolling of the intermediate product I causes the tip-paper piece Pc to come off the peripheral surface of the receiving drum 38 and to adhere to the peripheral surface of the intermediate product I. The tip-paper piece Pc is, in its last phase, wrapped around the intermediate product I with its both ends overlapping each other.

It is to be noted that when the tip-paper piece Pc is wrapped around the present intermediate product I, that is, when the present intermediate product I rolls for its first one rotation in the rolling passage 52, the trailing edge of the tip-paper piece Pc overtakes the next intermediate product I without touching the next intermediate product I, because the peripheral speed $V_2$ of the receiving drum 38 is, as stated above, determined to be twice as high as the carrying speed $V_1$ of the intermediate product I. As a result, the next intermediate product I and the next tip-paper piece Pc are synchronized with each other to come into the rolling passage 52.

As mentioned above, the first one rotation of the intermediate product I in the rolling passage 52 is done in the area $L_1$ of the rolling surface 49, and the area $L_1$ is formed as a grip surface 57 which can cover the full length of the intermediate product I. Therefore, the intermediate product I rolls on the rolling surface 49, that is, the gripping surface 57 without slipping, so that the tip-paper piece Pc is wrapped around the intermediate product I in a stable and secure manner.

The intermediate product I around which the tip-paper piece Pc has been wrapped completely, that is, the double-filter-cigarette DFS then rolls for further two rotations in the rolling passage 52 as the receiving drum 38 rotates, and then comes out of the rolling passage 52 and passes onto the entrance drum 42 of the drum train 34.

Since the rolling plate 48 is heated by the electric heater 51 contained in the holder 50, the surface of the tip-paper piece Pc to which glue has been applied is quickly dried after the tip-paper Pc is wrapped around the intermediate product I, so that the tip-paper piece Pc adheres to the intermediate product I more firmly.

Figure 5:
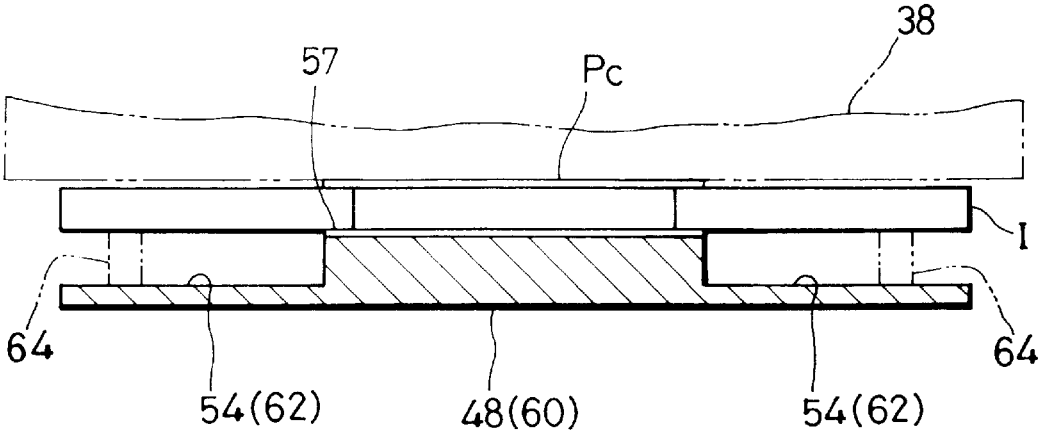
FIG. 5 is a cross-sectional view of the rolling plate of FIG. 2.

The rolling surface 49 on which the double-filter- cigarette DFS rolls in the rolling passage 52 comprises only the surface left between the pair of receding portions 54. Therefore, as shown in FIG. 5, the double-filter-cigarette DFS is held between the rolling plate 48 and the receiving drum 38 only at its central portion, that is, the portion around which the tip-paper piece Pc is wrapped. The cigarette portions on the left and right of the central portion are not held by the rolling plate 48 and the receiving drum 38. Therefore, the left and right cigarette portions are prevented from being kneaded and loosened as the double-filter-cigarette DFS rolls, and the hardness of the cigarette portions are maintained sufficiently.

TABLE 1

| | Difference in distortion ratio in the vertical direction | Difference in distortion ratio in the horizontal direction | Averaged distortion ratio |
|---|---|---|---|
| Rolling plate (Conventional) | 2.67 | 3.12 | 2.89 |
| Rolling plate (Present embodiment) | 2.03 | 1.35 | 1.69 |
| | Improvement | | −1.20 |

Table 1 shows the result of sampling inspection of manufactured filter-cigarettes FS. In the sampling inspection, the single-cigarette included in the intermediate product I before passing though the rolling passage 52, and the cigarette portions of the double-filter-cigarette DFS after passing though the rolling passage 52 were inspected. The hardness of such object of inspection, that is, the distortion ratio thereof was measured in two directions perpendicular to each other. The result of inspection in table 1 shows a difference ($\Delta_1 9-A_2$) between a first distortion ratio $\Delta_1$ which an object of inspection shows after passing through the rolling passage 52 and a second distortion ratio $\Delta_2$ which the object of inspection shows before passing through the rolling passage 52. Here, the distortion ratio means a ratio (%) of deformation which an object of inspection shows when a predetermined load is applied to it. Table 1 also shows the result of inspection which was done on filter-cigarettes manufactured using a conventional rolling plate. In Table 1, the vertical direction means the direction of a normal line to the lap portion of the wrapping paper of an object of inspection.

As clear from Table 1, when the above mentioned rolling plate 48 is used, the object of inspection, that is, the cigarette portion shows a smaller difference in distortion ratio than when the conventional rolling plate is used. This means that while the intermediate product I passes through the rolling section 6, the cigarette portions are less kneaded and loosened, and more maintains the hardness thereof.

Therefore, the amount of shredded tobacco which falls off both ends of the double-filter-cigarette DFS or the distal end of the filter-cigarette FS while the double-filter-cigarette coming out of the rolling section 6 is carried on the drum train 34 is reduced to a large extent.

Figure 6:
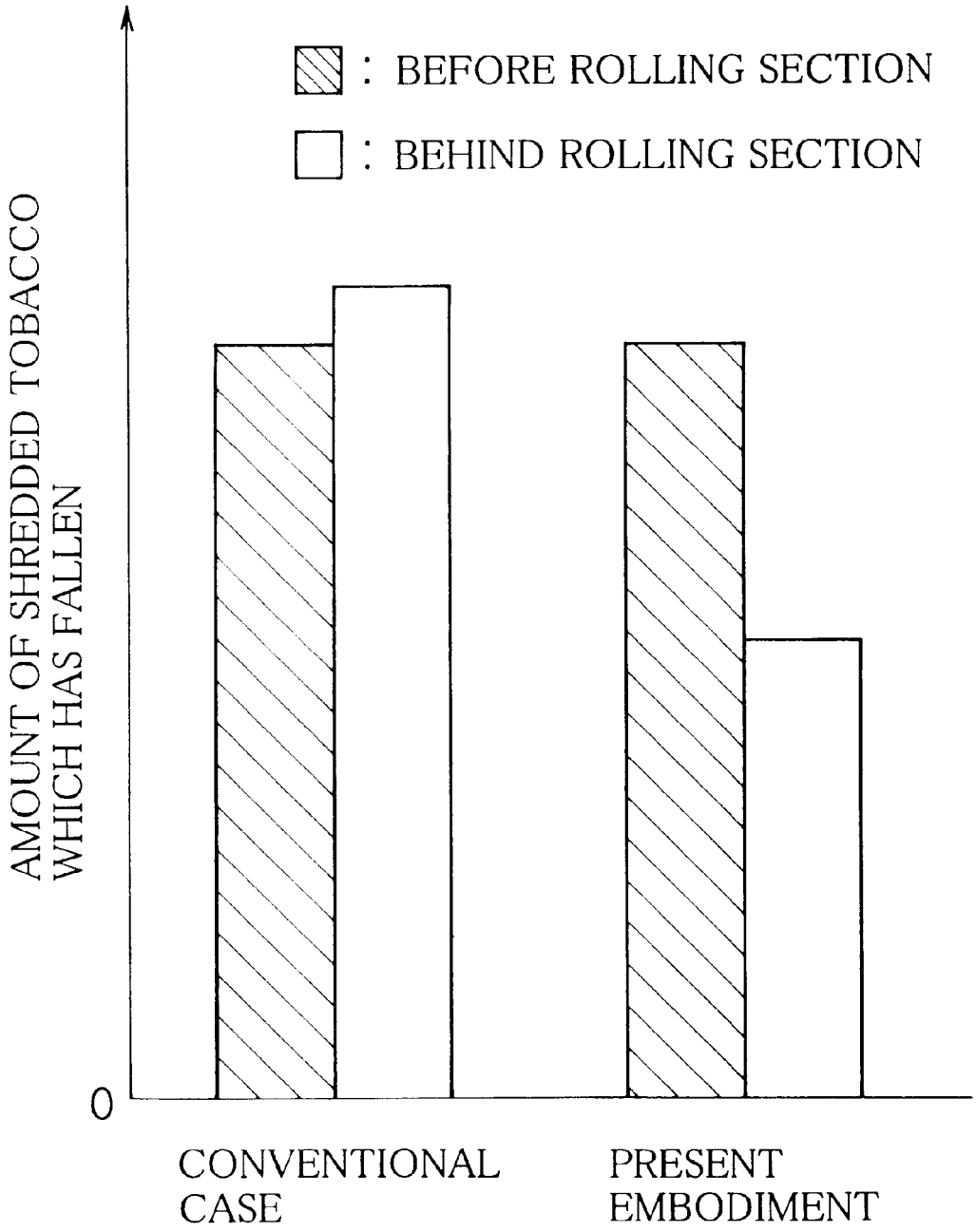
FIG. 6 is a graph proving effectiveness of the rolling plate of FIG. 2.

FIG. 6 compares the amounts of shredded tobacco which falls off the object of inspection before and behind the rolling section 6 comprising a conventional rolling plate and the amounts of shredded tobacco which falls off the object of inspection before and behind the rolling section 6 comprising the rolling plate 48 of the present embodiment. In view of the amount of shredded tobacco which falls off the object of inspection after it has passed through the rolling section 6, the amount of shredded tobacco which falls is much less in the present embodiment than in the conventional case.

The falling of shredded tobacco before the object of inspection's passing through the rolling section 6 takes place mostly at the time the double-cigarette D is cut as stated above.

In the conventional case, the amount of shredded tobacco which falls after the object of inspection passes through the rolling section 6 is larger than the amount of shredded tobacco which falls before the object of inspection passes through the rolling section 6. In contrast thereto, in the present embodiment, the amount of shredded tobacco which falls after the object of inspection passes through the rolling section 6 is much less than the amount of shredded tobacco which falls before the object of inspection passes through the rolling section 6. This also means that the cigarette portions are less kneaded and loosened in the rolling section 6, and more maintains the hardness thereof. Thus, when the rolling plate 48 of the present embodiment is used, shredded tobacco's falling of f the end of the filter-cigarette FS, that is, the defective of cigarette end is reduced to a large extent, and efficiency of manufacturing the filter-cigarette is improved.

Figure 7:
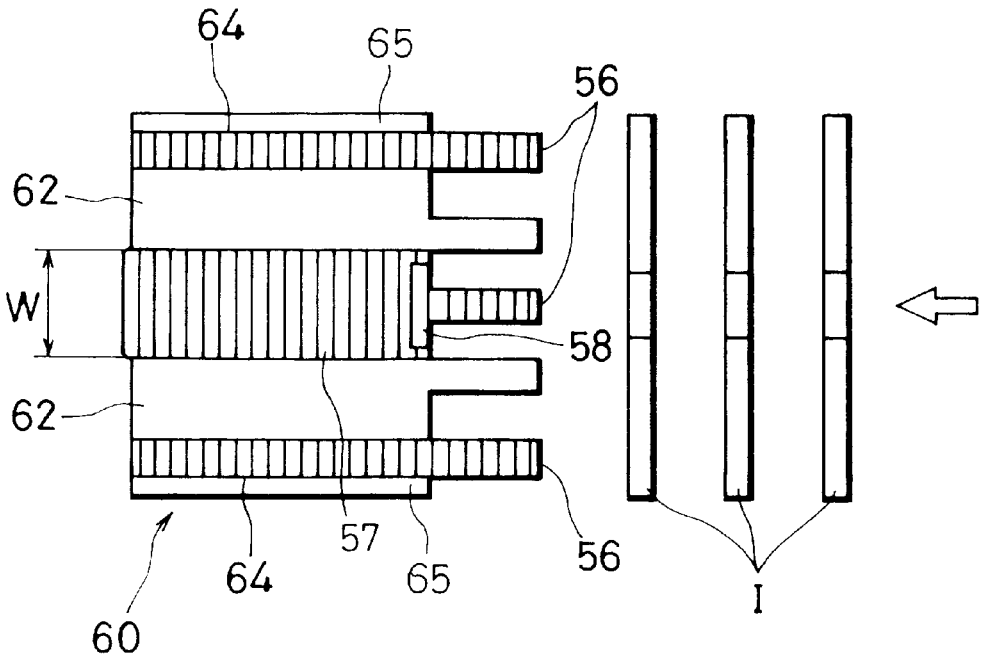
FIG. 7 is an illustration showing another embodiment of the rolling plate.

FIG. 7 shows a rolling plate 60 of another embodiment. The rolling plate 60 has a pair of receding portions 62 at its upper surface, that is, the rolling surface. The receding portions 62 differ from the receding portions 58 of the rolling plate 48 shown in FIG. 3 in the following points. While the receding portions 54 are formed only on the downstream-side portion of the rolling plate 48, the receding portions 62 extend over the total length of the rolling plate 60 from its upstream-side end to its downstream-side end. Further, as clear from FIG. 7, the pair of receding portions 62 are formed in a manner that both side edge portions of the rolling plate 60 are left. The side edge portions are formed as a pair of gripping surfaces, that is, left and right gripping surfaces 64. Thus, when the intermediate product I or the double-filter-cigarette DFS rolls on in the rolling passage 52, both ends of the intermediate product I or the double-filter-cigarette DFS are supported on the gripping surfaces 64 indicated by a two-dot chain line in FIG. 5. On both side edges of the rolling surface, second receding portions 65 are formed. The second receding portions 65 extend along the receding portions 62. The second receding potions 65 prevent both ends of the intermediate product I or the double-filter-cigarette DFS from touching the rolling plate 60, so that both ends of the intermediate product I or the double-filter-cigarette DFS are less kneaded and loosened.

With the above described rolling plate 60, the area of the rolling surface which comes in contact with the intermediate product I or the double-filter-cigarette DFS is reduced, and stable rolling of the intermediate product I or the double-filter-cigarette DFS is ensured.

Also in the rolling plate 48, the left and right receding portions 54 may extend over the total length of the rolling surface from its upstream-side end to its downstream-side end. In that case, the area of the rolling plate 48 which comes in contact with the intermediate product I is further reduced.

Figure 8:
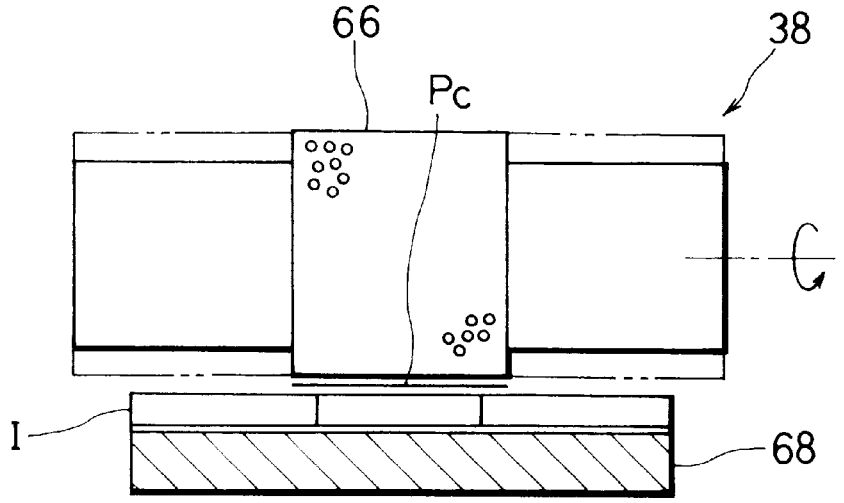
FIG. 8 is an illustration showing another embodiment of the rolling section.

In each of the embodiments described above, a pair of receding portions are formed on the left and right sides of the rolling surface to reduce contact resistance produced on the intermediate product I or the double-filter-cigarette DFS in the rolling passage 52. Alternatively, as shown in FIG. 8, the receiving drum 38 may comprise small diameter portions at both ends thereof. The small diameter portions have a diameter slightly smaller than the diameter of the suction surface forming portion. Also with such receiving drum 38, contact resistance produced on the intermediate product I or the double-filter-cigarette DFS in the rolling passage 52 is reduced in the same way. In this case, receding portions do not need to be formed on the rolling plate.

What is claimed is:

1. A filter attaching device, comprising supply means including a receiving drum adapted to rotate and round in shape, for supplying a tip-paper piece on a supply path provided by a peripheral surface of said receiving drum, a rolling plate having a rolling surface of an arc-like shape extending along the peripheral surface of said receiving drum, the rolling surface and the peripheral surface defining a rolling passage having an entrance and an exit, and introducing means for introducing, from the entrance into the rolling passage, a rod-like intermediate product for a double-filter-cigarette having a filter plug interposed between two cigarettes, wherein the rolling passage has a width at least as large as the length of the intermediate product, and is arranged such that while the intermediate product is made to roll on in the rolling passage from the entrance to the exit, the tip-paper piece is wrapped around the intermediate product to thereby form a double-filter-cigarette, said filter attaching device further comprises reducing means for reducing contact resistance produced on the cigarettes included in the intermediate product by the rolling passage, and said reduction means including a pair of receding portions formed on at least one of the peripheral surface of said receiving drum and the rolling surface, the receding portions being apart from each other to the left and right with a distance corresponding to the width of the tip-paper piece as viewed in the direction in which the intermediate product rolls on, and extending along the rolling passage.

2. The filter attaching device according to claim 1, wherein the pair of receding portions are formed on the rolling surface and extend along the rolling passage excluding an entrance portion of the rolling passage, and each of the receding portions opens sideward at the corresponding side edge of the rolling surface.

3. The filter attaching device according to claim 2, wherein the entrance portion has a length required for allowing the intermediate product to roll for a first one rotation from the entrance into the rolling passage.

4. The filter attaching device according to claim 1, wherein the pair of receding portions extend from the entrance to the exit of the rolling passage.

5. The filter attaching device according to claim 4, wherein the pair of receding portions are formed in a manner that both side edge portions of the rolling surface are left.

6. The filter attaching device according to claim 5, wherein the rolling surface further comprises second receding portions provided on both side edges of the rolling surface to extend along said receding portions.

7. The filter attaching device according to claim 1, wherein the rolling surface has a projecting ridge at the entrance of the rolling passage, and the projecting ridge is an arc-like shape in cross section and extends in the direction traversing the rolling passage.

* * * * *